United States Patent [19]

Lewis et al.

[11] 4,455,147

[45] Jun. 19, 1984

[54] TRANSFER PRINTING

[75] Inventors: David M. Lewis, Otley, England; Peter R. Brady, Highton, Australia; Peter G. Cookson, Belmont, Australia; Keith W. Fincher, East Geelong, Australia

[73] Assignees: I.W.S. Nominee Company, Limited, London, England; Commonwealth Scientific and Industrial Research Organization, Canberra, Australia

[21] Appl. No.: 247,790

[22] Filed: Mar. 26, 1981

Related U.S. Application Data

[63] Continuation of Ser. No. 057,015, Jul. 12, 1979, abandoned.

[30] Foreign Application Priority Data

Oct. 9, 1978 [AU] Australia ..... PD6308

[51] Int. Cl.[3] ..... D06P 1/16; D06P 1/62; D06P 1/653; D06P 1/667

[52] U.S. Cl. ..... 8/471; 8/467; 8/470; 8/930; 427/394; 427/396; 428/270; 428/274; 428/275; 428/276

[58] Field of Search ..... 8/471, 467, 470, 930; 428/270, 274, 275, 276

[56] References Cited

U.S. PATENT DOCUMENTS

| | | | |
|---|---|---|---|
| 3,686,025 | 8/1972 | Morton | 428/274 |
| 4,029,467 | 6/1977 | Defago et al. | 8/2.5 A |
| 4,033,716 | 7/1977 | Defago et al. | 8/2.5 A |
| 4,063,879 | 12/1977 | Faulhaber et al. | 8/2.5 A |
| 4,072,462 | 2/1978 | Vellins et al. | 8/2.5 A |
| 4,155,707 | 5/1979 | Franceschini et al. | 8/2.5 R |

FOREIGN PATENT DOCUMENTS

| | | |
|---|---|---|
| 2418519 | 4/1974 | Fed. Rep. of Germany . |
| 1223330 | 6/1960 | France . |
| 48-65677 | 10/1973 | Japan . |
| 1254021 | 11/1971 | United Kingdom . |
| 1320819 | 6/1973 | United Kingdom . |
| 1403119 | 8/1975 | United Kingdom . |

OTHER PUBLICATIONS

American Dyestuff Reporter, pp. 31–35, (6–5–67).

*Primary Examiner*—Paul R. Michl
*Attorney, Agent, or Firm*—Dennis P. Clarke

[57] ABSTRACT

Color yield of the coloration processes for textile and like materials, more especially of sublimable dyes applied by transfer printing, is enhanced by pretreatment of the material by deposition of 1 to 10% surfactant or other amphipathic substance. Preferred substances are cationic, anionic or non-ionic surfactants, which may be applied from aqueous solution at levels of 1 to 10% on the weight of the material. The material is dried before printing. The surfactants can be accompanied by swelling agents, catalysts or cross-linking agents. Preferred dyes for the printing stage are sublimable dyes containing chelatable groups, fibre-reactive groups or cross-linkable groups.

8 Claims, No Drawings

TRANSFER PRINTING

This application is a continuation of application Ser. No. 057,015, filed July 12, 1979, now abandoned.

This invention concerns the printing of textile materials.

Sublimation transfer printing, also known as dry transfer printing, of synthetic fibres, such as polyester, acrylic, triacetate, and polyamide, is well known (French Pat. No. 1,223,330). The reverse multi-colour design is first printed onto paper by normal paper-printing equipment and techniques, using disperse dyes of the type normally used to colour synthetic fibres and which sublime at temperatures below 220° C. Later, the paper and fabric to be printed are placed in close contact and passed through a hot calender or heated in a press for up to 2 minutes. In practice the lower temperature limit is determined by the volatility of the dye, and the upper limit is set by the need to avoid fabric damage or melting during the transfer step.

It is well known that all classes of disperse dyes have relatively little affinity for wool and other natural fibres and so it is not unexpected that when these fibres are printed with disperse dyestuffs by sublimation methods the colour yields of the prints are unacceptably poor.

The present invention provides compositions and methods of preparing fabrics, other textile materials, or related materials for printing, and methods for sublimation transfer printing of such materials to produce prints with good colour yields.

In accordance with this invention, textile fibres or materials, or other organic sheet materials, are prepared for coloration by the application of an amphipathic substance containing in its molecule both polar and non-polar groupings. The substance is preferably applied from a liquid (usually aqueous) vehicle or medium, for example by spraying, dipping, padding or printing, or by exhaustion from a bath, notably at liquor to material ratios of 5:1 or above (by weight).

The dye to be employed in colouring the material is then applied in the presence of the amphipathic substance, either simultaneously therewith or, more usually, in a subsequent operation, usually printing.

The amphipathic substances employed in the preparation or pretreatment that characterizes this invention will usually include hydrophilic and hydrophobic organic moieties in their molecules and be surface active. They are typically applied for the purposes of this invention at levels of 1 to 10% on the weight of fibers (o.w.f.).

The method of this invention is particularly suited to the treatment of textile and like materials to be coloured by the technique of sublimation transfer, and for this purpose a sublimable dye, usually a disperse dye, is applied to the material in the presence of the amphipathic substance, and the material subsequently heated, usually between 150° and 240° C., or in superheated steam, for example at 150° to 180° C.

The process of the invention is applicable to textile materials such as woven, knitted or non-woven protein-containing fabrics such as wool and silk, polyamides such as nylon, and cellulosics such as cotton, linen, viscose, cellulose acetate etc., and to textile-related materials such as laminates and leather.

It is known that sublimable dyes, intended for printing polyester, generally give prints with very poor fastness properties on wool and cotton. However, there are three classes of sublimable dyes which give prints with improved wet fastness properties. These are dyestuffs containing groups which react with the fibres, including those described in British Pat. No. 1,254,021, dyestuffs which form metal co-ordination complexes on the printed material, including those described in British Pat. No. 1,320,819, and dyestuffs which are crosslinked to one another or to suitable reactive groups in the material to be printed, including those described in U.S. Pat. No. 4,029,467. It is intended that when both good colour yields and good wet fastness properties are required, these types of dyestuff should be printed onto materials by the method of this invention, but the method is not restricted solely to these types of dyestuff.

The methods are eminently suitable for printing of blends of fibres (natural and/or synthetic) because the dyes and conditions can be selected to colour the different fibres simultaneously. The principles of the invention can also be applied to the printing of material with compounds other than, or in addition to, dyes, to produce various colouration effects, for example, volatile fluorescent-brightening, dye-assist, or dye-resist agents, or their precursors. In the following description of the invention, it is to be understood that such compounds may also be intended where the word "dye" is used.

The method of the invention for preparing a material for printing is described in that part of the text relating to Step 1 of the complete method of the invention for sublimation transfer printing. The preparation method of Step 1 could also be used to advantage with other methods of printing.

The complete method of the invention for sublimation transfer printing comprises the following steps:

Step 1. Pretreating the material to be printed with a composition characterized in that it contains one or more compounds chosen from Class 1(a) below, as herein defined, together with one or more compounds chosen from one or more of the following Classes 1(b) to 1(h):

1(*a*) Compounds that enhance the colour yield of the selected dyes on the material to be printed.

1(b) Compounds that promote diffusion of dye in the fibres of the material by swelling or other means.

1(c) Salts of metals capable of forming chelates with dyes of suitable structure.

1(d) Carboxylic acids.

1(e) Compounds that react with or crosslink selected dyes to increase their molecular size or bind them to the fibre and so increase their fastness properties.

1(f) Compounds that catalyse the reaction or interaction of selected dyes with the fibres or themselves to increase their fastness properties.

1(g) Compounds that confer other desired textile properties.

1(h) Solvents or vehicles in which the foregoing compounds are dissolved or dispersed.

Step 2. Printing of designs on a transfer substrate using one or more sublimable dyes.

Step 3. The printed substrate and material to be printed are placed together and passed through a heated calender or heated in a press at temperatures up to 220° C. for up to 2 minutes; 30 seconds at 200° C. is typical.

Step 4. The printed material is then steamed for up to 60 minutes at 100°–120° C. in superheated steam, 30 minutes at 100° C. is typical, or at up to 200° C. in superheated steam, before or after separation of the spent transfer sheet. Steaming is intended to promote diffusion of dye into the interior of the material and to promote the desired reactions of the dye or its interactions with the material when this is appropriate, depending on the types of dyestuff employed and the desired fastness properties. We have found that with some particular combinations of materials, compounds, and dyestuffs, steaming may not be required.

The printed material is then ready for use. A feature of the invention is that the material does not require to be washed after printing to remove unfixed dye and printing auxiliaries; this procedure is necessary in conventional printing and wet and melt transfer printing of natural materials.

Steps 1 and 2 may be carried out in any convenient order. Steps 3 and 4 may be carried out in that order in separate machines or concurrently or sequentially on the one machine of appropriate type.

The composition of Step 1 need only contain components 1(a) and 1(h) but other components 1(b) to 1(g) are included to suit the characteristics of particular dyes or to achieve certain textile properties.

The composition of Step 1 may be applied by any convenient known technique such as padding, spraying, impregnation and centrifuging or exhaustion, followed by drying of the material. Also, it may be applied at any convenient stage of processing such as to loose fibre, sliver, yarn or fabric.

Suitable compounds for the Step 1 compositions will now be described in greater detail. Compounds with the properties specified in Classes 1(b)-1(g) are relatively well known, as is their individual application to textiles for the stated purpose.

1(a) Colour yield enhancing compounds. We have found that many apparently unrelated compounds will confer this desirable property when applied to the material to be printed. We believe, without the intention of confining the invention by the correctness or otherwise of the belief, that suitable compounds contain both polar and non-polar groups and that the composition applied to the material to be printed confers an enhanced affinity for disperse dyes by virtue of a similarity in polar/non-polar character between the dyestuffs and the substances comprising the composition. Surfactnats have such mixed hydrophobic-hydrophilic characteristics and, although we have obtained excellent results with all classes of surfactants (anionic, cationic, amphoteric, and nonionic) we believe that compounds not normally regarded as surfactants, because of their low molecular weights or because of their specialised end uses, such as textile spinning oils and fibre lubricants, but with the correct mixture of the above characteristics, are also suitable.

The non-polar portion of a colour yield enhancing compound should consist of one or more alkyl groups which may or may not be attached to an aromatic nucleus. The alkyl groups preferably contain from one to twenty carbon atoms may be in straight, branched, unsaturated or ring chain configurations. Aromatic nuclei to which the alkyl chains may be attached are preferably benzyl, phenyl, diphenyl, naphthalene, naphthol, dinaphthylmethane or tetrahydronaphthalene residues.

The polar portion of a colour yield enhancing compound should consist of one or more anionic, cationic or nonionic groups. Various types of polar groups may be present in the one molecule. Suitable anionic groups are carboxylate, sulphate, thiosulphate, sulphonate, sulphinate, sulphamate, phosphate, pyrophosphate and phosphonite groups. Suitable cationic groups include protonated primary, secondary and tertiary amine groups as well as quanternary ammonium, pyridinium, picolinium, imidazole, benzimidazole, tertiary oxonium, tertiary sulphonium and quaternary phosphonium groups. Suitable nonionic polar groups are (i) alcoholic hydroxyl groups derived from polyalcohols, (ii) either alcohols or alkanolamides, (iii) either groups derived from ethylene or propylene oxide including polymers of these compounds and (iv) primary and secondary amide groups and amine oxides.

In certain cases, the polar group may be capable of reaction with the material to be printed, for example compounds containing the thiosulphate group when applied to wool. This could have advantages where a more permanent effect is desired, or where increased wettability, wicking etc. due to the presence of a free polar group is undesirable. In some circumstances it may be desirable to mix two or more compounds, for example, to achieve a given balance of polar and non-polar characteristics, or, in exhaustion treatments, to increase the substantivity of an anionic compound by the addition of an amphoteric compound.

A more detailed description of suitable compounds of the various classes now follows. From this, those skilled in the art should be able to deduce other suitable compounds.

1(a) Colour yield enhancing compounds.

| Type | Trade Name | Chemical Constitution |
|---|---|---|
| anionic | Soap flakes | sodium stearate |
| anionic | Aerosol OT | sodium di-isooctyl-sulphosuccinate |
| anionic | Alkanate D | sodium dodecyl-benzenesulphonate |
| anionic | Gardinol WA | sodium laurylsulphate |
| anionic | Igepon T | N—methyltaurine adduct of oleic acid chloride |
| anionic | Nekal A | alkylnaphthalene sulphonate |
| anionic | Ultravon K | sulphonated alkyl-benzimidazole |
| nonionic | Dispersol VP | lauryl diethanolamide |
| cationic | Cetramide | cetyltrimethylammonium bromide |
| cationic | Vantoc CL | cetylbenzyldimethyl-ammonium chloride |
| cationic | Sapamine A | condensate of fatty acid chloride with diethyl-ethylene diamine |
| amphoteric | Miranol CM Conc. | imidazoline derivative |
| cationic | Alliquat 336 | N—trioctyl-N—methyl ammonium chloride |

The amount of 1(a) compound(s) employed should be sufficient to leave 1-10% by weight on the material, preferably 2-5%. It is well known to use certain surfactants in textile-treating compositions to promote wetting of the material by the composition, but in such cases the amounts employed are less than 1%.

1(b) Dye diffusion promoters. These are often used in conventional printing pastes. Some well known examples are urea, thiourea, thiodiglycol, acetamide, formamide, dimethyl-sulphoxide, ethylene glycol and lactic acid. Urea and lactic acid are preferred because of their cheapness and low volatility. The amount(s) of compound(s) employed should be sufficient to leave 1-20% by weight on the material and preferably 2-10%.

1(c) Chelating metals. The addition of chelating metals is required when it is desired to form metal complexes with suitable dyestuffs.

Chelating metals will normally be in the form of the salt of a mineral or organic acid for convenience, although the use of metal complexes is by no means excluded. Suitable metal salts are those of aluminium and zinc as well as any of the transition metals of the periodic table. Particularly with o,o'dihydroxyazo dyes, chromic chloride, chromic acetate and chromic lactate are preferred because they usually give the deepest and fastest colours with a wide range of hues. Also, good results have been obtained with iron, nickel, copper and cobalt salts.

The amount employed should be sufficient to leave 0.1–3% by weight on the material and preferably 0.2–1.0%.

1(d) Carboxylic acids. When printing material with dyestuffs which form complexes with metal salts, a carboxylic acid should be added to the liquor in an amount between 0.1 and 10% on the weight of the material. Carboxylic acids particularly preferred are those containing hydroxyl groups such as lactic and citric acids added in amounts between 0.5 and 2.0%.

1(e) Crosslinker. The word "crosslinker" is used in its well known sense, particularly in relation to polymer chemistry, to mean a compound with two or more groups capable of reaction with the functional groups in the dyes or the fibres to convalently bind two or more dye molecules together or bind them to the fibre. Suitable reactive groups and functional groups are too well known to require enumeration here. However the preferred compounds are those containing epoxide, isocyanate, methylol, ethylenically unsaturated or aziridine groups or groups capable of forming these and which are able to crosslink with hydroxyl, carboxyl, amine and amide groups on suitable dyestuffs and materials to be printed. The only restrictions on the choice of crosslinker are that they should be small enough to penetrate the fibres during the transfer or steaming steps yet be sufficiently involatile to remain on the material while it is stored between pretreatment and printing.

1(f) Catalysts. These could be employed either when crosslinkers are added to the composition or when reactive dyes are used in Step 2. These are widely used in polymer and dyestuff chemistry and are too well known to require enumeration here. The can be acids, alkalis, amines, organometallic or other compounds depending on the identity of the reactive groups in the dyes or crosslinkers and the correct choice is well known to those skilled in the art.

When printing cotton fabric with fibre reactive dyes, the presence of an inorganic or organic base is desirable to increase the rate of reaction between the dyestuff and cellulose. In this invention the base is added to the pad liquor and applied to the fabric before printing. Suitable bases include hydroxides, carbonates and bicarbonates of the alkali metals in an amount between 0.1 and 10% on the weight of the materials.

1(g) Textile property improver. Typical examples are the well known polymers used to impart various easy-care properties such as dimensional stability, and resistance to wetting, soiling, abrasion, pilling, etc. and the formulation could also include curing aids either within or outside the scope of the compounds described under 1(e) and 1(f). Other types of compound could also be added, e.g., bleaching or whitening agents, handle modifiers, sewing aids or mothproofing agents. The yellowing of wool fabrics at the temperatures encountered in transfer printing can be inhibited by the addition of an involatile strong acid such as sulphamic acid to the pad liquor.

1(h) Solvent. The most common and preferred vehicle for dissolving or dispersing the foregoing compounds is water.

However, with certain of the compounds it may be found more convenient to use other solvents, either miscilbe or immiscible with water, or mixed solvents (including water).

Step 2 can be carried out using any convenient known printing technique including flexographic, gravure, lithographic, letterpress, spray or screen printing. Suitable substrates to be printed include paper, plastic film and metal foil. Most suitable are machine-glazed Kraft papers specially prepared for transfer printing which are well known to those skilled in the art.

The required characteristics of the dyes used in Step 2 will now be discussed in more detail. Suitable dyes will generally be of low molecular weight (150–450) and they will have sufficient volatility at temperatures below 220° for 10% or more of the dye to sublime from the paper to the material in 2 minutes or less during the heat transfer step.

Although the use of dyestuffs commonly used for sublimation transfer printing of polyester, nylon and acrylic is by no means excluded, in order to obtain prints with acceptable levels of fastness to washing, drycleaning, abrasion and fading, it may be necessary to use special types of sublimable dyestuffs with one or more of the following characteristics. Certain dyes, which in their coloured form are not sufficiently volatile, may be printed onto paper in another, more volatile form, e.g. the unchanged carbinol base of triarylmethane basic dyes which converts to the involatile charged coloured form after transfer to the material.

2(a) Contain one or more groupings within the molecule which are capable of forming chelates with metals or their salts. Any of the groups normally found in mordant dyes are suitable, for example, mono- or polyhydroxyl, carboxyl, amino, nitroso, or mixtures of them, adjacent to (usually in the ortho or 1:8 positions) each other or to diazo or imino groups. Dyes containing one or more carboxyl groups usually need to be printed onto paper in the free acid from or as the ammonium salt of the carboxylic acid, as only the free acid form is sufficiently volatile. In order to ensure that the dye sublimes as the free acid, a small quantity of an involatile strong acid, such as sulphamic acid, should be added to the print paste.

2(b) Reactive groups. These are well known in water soluble reactive dyes most of which are not sublimable. The reactive groups must be sufficiently small and non-polar to not reduce dye volatility unduly. Examples of suitable groups are epoxide, activated halide, chloracetylamino, chloroacetate, chloromethyl, vinylsulphone, carboxylazide or sulphonylazide. Precursors or derivatives of such groups that convert to a volatile form during the transfer step may also be used, for example, chlorohydrin or β-sulphatoethylsulphone. Dyestuffs which contain blocked reactive groups are also suitable provided they may be activated by removal of the blocking group under the conditions used for sublimation transfer and dyestuff fixation. Effective examples include dyes containing isocyanate groups which have been blocked by reaction with phenols, oximes or alcohols.

2(c) Contain one or more groups within the molecule that are capable of reaction with Class 1(e) compounds so as to increase the molecular size of the dyestuff or to covalently bond it to the material being printed during the sublimation transfer and dyestuff fixation steps. Examples of suitable groups are hydroxyl, amino, imino or carboxyl, but unlike the substituents on the metallisable dyes, they need not be in any particular configuration.

Dyes with different characteristics may be mixed to achieve a desired range of colours.

It has been found that yellowing and fibre damage may tend to occur in the case of keratin fibres when certain of the compounds mentioned are applied to wool and heated in the manner described. This may be overcome by the inclusion of a non-volatile acid. Sulphamic acid is a particularly preferred example of a non-volatile acid for present purposes, giving significant reductions in fibre damage as well as preventing yellowing. Other acids that may be used to reduce yellowing include phosphoric, citric and trichloroacetic acid.

Any class of disperse dye can be applied by the method of this invention, especially when applied by the direct printing or padding technique followed by high temperature steam or dry heat (thermosol) development. Sublimable dyes are required when a transfer technique is to be employed. Increased colour fastness can be obtained by the use of reactive disperse dyes.

In transfer printing, a preferred range of dyes is that marketed under the Trade Mark SUBLINYL. These dyes are believed to have a fibre-reactive group in their molecule, although their usefulness is in no way dependent on the accuracy of this belief.

The invention is of particular value in respect of wool, but since disperse dyes are not only applicable by this method to natural fibres but remain applicable to synthetic fibres, the invention affords a method of obtaining more solid printed or padded shades on mixed fabrics of natural and synthetic fibres, for example cotton and polyamide and, in particular, wool and polyester mixtures.

The invention is illustrated but not limited by the following examples:

EXAMPLE 1

A plain-weave shirting wool fabric of 160 g/m$^2$ was padded at 60% pick-up with a liquor containing 66.7 g/kg sodium dodecylbenzenesulphonate, 83.3 g/kg urea, 8.3 g/kg chromic chloride pentahydrate, 13.3 g/kg lactic acid and 828.4 g/kg water. The fabric was dried at 150° C.

Transfer papers were prepared by dispersing the dyes given in the table below in a paste containing 62.5 g/kg Solvitose MVS (Scholten), 12.5 g/kg Teric 16A29 (ICI, 125 g/kg white spirit and 800 g/kg water and printing the pastes onto machine-glazed Kraft paper by flat screen methods.

Prints were produced on the pretreated fabric by heating it in contact with the transfer papers in a hot-head press at 200° C. for 30 seconds. After transfer the fabric was steamed in an autoclave at 100° C. for 30 minutes.

Well-defined, bright and strong prints of at least standard depth according to BS 2661:1961 were obtained. In ISO rubfastness and ISO 2 washfastness tests the prints rated 4 or better and in the ISO lightfastness test rated 5 or better. On untreated fabric pale prints with poor fastness properties resulted.

| Dye | Concentration in Print Paste | Colour on Pretreated Wool |
|---|---|---|
| (I) 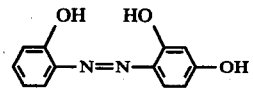 | 7.5g/Kg | Red |
| (II) 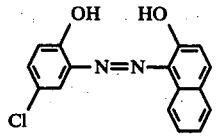 | 7.5g/Kg | Navy blue |
| (III) 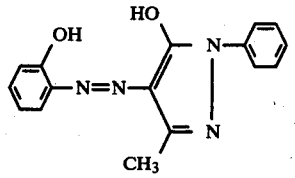 | 10g/Kg | Orange |

EXAMPLE 2

The procedure of Example 1 was followed except that the transfer papers were printed with the dyes in the table below and 20 g/kg of water in the print paste used to prepare the transfer papers was replaced with 20 g/kg sulphamic acid. Bright clear prints of better than standard depth were obtained with excellent fastness to rubbing, washing and light fading.

| Dye | Concentration in Print Paste | Colour on Pretreated Wool |
|---|---|---|
| 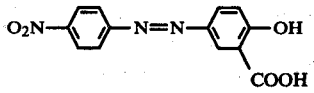 | 20g/Kg | Orange |
| 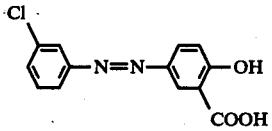 | 20g/Kg | Yellow |

EXAMPLE 3

The procedure of Example 1 was followed except that Aerosol OT (sodium di-isooctylsulphosuccinate, Cyanamide) was substituted for sodium dodecylbenzenesulphonate. Similar results in respect of colour yields and fastness properties were obtained.

EXAMPLE 4

The procedure of Example 1 was followed with the exception that thiodiglycol was substituted for urea in the pad liquor. Similar results in respect of colour yields and fastness properties were obtained.

EXAMPLE 5

The procedure of Example 1 was followed with the exception that citric acid was substituted for lactic acid in the pad liquor. Similar results in respect of colour yields and fastness properties were obtained.

EXAMPLE 6

The procedure of Example 1 was followed except that chromic acetate was substituted for chromic chloride pentahydrate in the pad liquor. Similar results in respect of colour yields and fastness properties were obtained.

EXAMPLE 7

The procedure of Example 1 was followed except that cobalt nitrate was substituted for chromic chloride pentahydrate. Prints with different hues but equally good fastness properties were obtained. Dye (I) gave a red-brown print, Dye (II) gave a lilac print and Dye (III) gave a golden orange print.

EXAMPLE 8

Fabric, as described in Example 1, was padded at 100% pickup with a liquor containing 20 g/kg Aerosol OT, 50 g/kg urea and 930 g/kg water. The fabric was dried, printed and steamed as in Example 1. The transfer paper was prepared as in Example 1 using a print paste containing 10 g/kg of the reactive disperse dye:

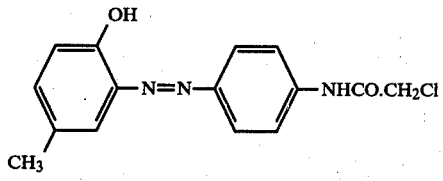

(IV)

A bright yellow print with excellent fastness to rubbing, washing and light fading was obtained. By comparison a very much paler print was obtained on untreated wool fabric.

EXAMPLE 9

The procedure of Example 8 was followed with the exception that Dye IV was replaced by the reactive disperse dye:

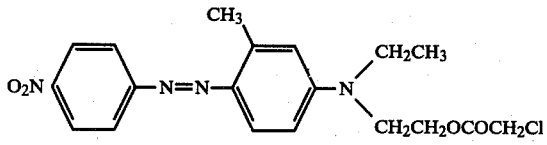

After steaming, a fast, bright red print was obtained. By comparison, only a very pale print was obtained on untreated fabric.

EXAMPLE 10

The procedure of Example 8 was followed with the exception that Dye IV was replaced by the reactive disperse dye:

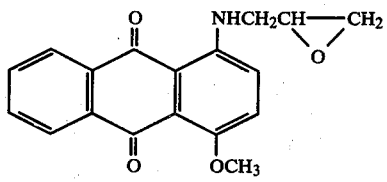

After steaming, a fast, bright violet print was obtained. By comparison, only a very pale print was obtained on untreated fabric.

EXAMPLE 11

The procedure of Example 8 was followed with the exception that Dye IV was replaced by C.I Disperse Blue 58. A fast bright blue print was obtained. By comparison only a very pale print was obtained on untreated fabric.

EXAMPLE 12

Wool fabric was treated as described in Example 8, and sublimation transfer printed with Sublacryl papers (papers printed with basic dyes and marketed by Sublistatic, S.A. of Geneva). After steaming, bright, deep prints were obtained. On untreated fabric, dull, weak prints were obtained.

EXAMPLE 13

The procedure of Example 12 was followed, except that 10% p-toluenesulphonic acid (ammonium salt) was included in the pretreatment. Even brighter, deeper prints were obtained in comparison with Example 12.

EXAMPLE 14

The procedure of Example 8 was followed except that the fabric was sublimation transfer printed with Sublinyl papers (papers printed with disperse dyes, for the printing of polyamide fabrics, from Sublistatic S.A.) After steaming, bright deep prints comparable to these obtained on polyamide were obtained. On untreated fabric, dull, weak prints were obtained.

EXAMPLE 15

The procedure of Example 14 was followed except that cetyldimethylbenzylammonium chloride was used in place of Aerosol OT. Similar good results were obtained.

EXAMPLE 16

Wool was treated in a bath set at a liquor: goods ratio of 30:1 with Aerosol OT (4% o.w.f.), ammonium sulphate (4% o.w.f.), Albegal B (2% o.w.f.) and sufficient acetic acid to bring the bath pH to 4.0. The bath was raised slowly to the boil and boiling continued for half an hour. The wool was dried and transfer printed at 200° C. for 30 seconds with Sublinyl papers. After steaming the print at 100° C. for 30 minutes, excellent colour yields were obtained in marked contrast to the yield on untreated wool.

EXAMPLE 17

The pretreatment of Example 16 was followed with the exception that Aerosol OT was replaced by the reactive surfactant, sodium lauryl S-thiosulphate acetate ester ($C_{12}H_{25}OCOCH_2SSO_3^-Na^+$). *Again very good transfer prints were obtained using the Sublinyl papers.*

EXAMPLE 18

Wool was treated in a bath set at a liquor:goods ratio of 30:1 and containing sodium acetate (1% o.w.f.) and the cationic surfactant cetyldimethylbenzylammonium chloride (4% o.w.f.). The bath pH was 7.0. This liquor was then slowly heated to 80° C. and the wool agitated at this temperature for half an hour. Following drying the wool was transfer printed and steamed as in Example 16. Once more very good quality transfer prints were obtained.

EXAMPLE 19

The compound p-N-chloroacetylamino salicylic acid was prepared by the reaction of chloroacetyl chloride with p-amino salicylic acid. This compound was printed on to paper from an aqueous paste containing sulphamic acid as described in Example 2. Nylon and wool fabrics were then dry transfer printed and steamed as in Example 1. At this stage there was no sign of any pattern on the fabrics but on piece dyeing with an anionic dye such as Lanasol Blue 3G, attractive white resists or half tone resists under a blue background were obtained.

EXAMPLE 20

A plain weave nylon fabric of 220 g/m$^2$ was padded to 100% pick-up with a liquor containing 50 g/kg of urea, 8 g/kg chromic chloride pentahydrate, 10 g/kg lactic acid, 20 g/kg Aerosol OT and 912 g/kg water. The fabric was the dried at 100° C. and printed as described in Example 1. Bright prints with the same colours as described in Example 1 were obtained.

EXAMPLE 21

A cotton fabric of 120 g/m$^2$ was padded to 100% pickup with a liquor containing 40 g/kg glycidyltrimethylammonium chloride, 100 g/kg urea, 8 g/kg chromic chloride pentahydrate, 10 g/kg lactic acid, 40 g/kg sodium dodecylbenzenesulphonate and 802 g/kg water. After drying the fabric was transfer printed as described in Example 1. Good quality prints results; they were similar in colour to those obtained on wool in Example 1. Very poor colour yields were obtained on untreated cotton.

EXAMPLE 22

Cotton fabric of 120 g/m$^2$ was padded at 100% pickup with a liquor containing 100 g/kg urea, 40 g/kg cetylbenzyldimethylammonium chloride, 50 g/kg sodium carbonate and 810 g/kg water. After drying, the fabric was printed as described in Example 1 with a transfer paper printed with the dye:

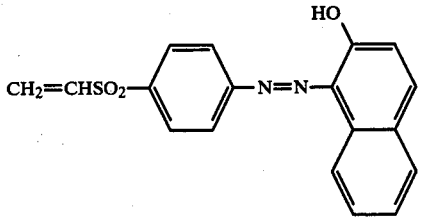

Bright, washfast prints were obtained without steaming after the transfer process. Prints with inferior colour yields were obtained on untreated fabric.

EXAMPLE 23

A 60/40 wool/polyester plain-weave blend fabric was padded at 100% pick-up with a liquor containing 20 g/kg cetylpyridinium chloride, 50 g/kg urea and 930 g/kg water. The fabric was dried at 100° C. and sublimation transfer printed, by the method described in Example 1, with the dyestuff employed in Example 22. Steaming was unnecessary, and a bright orange print of very good wash fastness was obtained. A print with inferior colour yield and fastness was obtained on untreated fabric.

EXAMPLE 24

The procedure of Example 23 was followed with the exception that Dye IV was used in place of the vinylsulphone derivative. Similar results in respect of colour yields and fastness properties were obtained.

EXAMPLE 25

The procedure of Example 8 was followed except that Dye IV was replaced by Sublaprint Red 70062 (L.B. Holliday Ltd.-believed to be a reactive disperse dyestuff). After steaming a bright red print was obtained with reasonable fastness to washing. By comparison, only a very pale print was obtained on untreated fabrics.

EXAMPLE 26

The procedure of Example 25 was followed, except that the dye was Intratherm Scarlet P355 (Crompton and Knowles—believed to be a reactive disperse dyestuff).

EXAMPLE 27

Wool was treated in a bath set at a 30:1 liquor to goods ratio and containing 4% o.w.f. Aliquat 336 and at pH 7. Exhaustion was carried out for 10 minutes at 20° C., then 2% o.w.f. Glaubers salt was added and exhaustion continued for a further 10 minutes. The temperature was then raised to 50° C. and exhaustion continued until the liquor became clear. After drying, the wool was transfer printed with Sublinyl papers and steamed as in Example 14. Very good quality prints were obtained.

EXAMPLE 28

The procedure of Example 27 was followed except that prior to the treatment with Aliquat 336, the fabric was first reductively treated for 30 minutes at a liquor ratio of 30:1 in a bath containing 5 g/e tiuc formaldehyde sulphoxylate (Blankit D BASF).

EXAMPLE 29

A 60:40 wool/polyester plain weave blend fabric was treated by the method described in Example 8. The fabric was dried, printed and steamed as in Example 8. A bright, solid yellow print with excellent fastness to rubbing, washing and light was obtained. By comparison, a very skittery print was obtained on untreated fabrics.

EXAMPLE 30

The procedure of Example 29 was repeated except that the dye was replaced by the dye from Example 9. A fast bright solid red print was obtained. By comparison, a skittery print was obtained on untreated fabric.

EXAMPLE 31

The procedure of Example 30 was followed except that the dye was Sublaprint Red 70062. Similar results were obtained.

EXAMPLE 32

The procedure of Example 30 was followed except that the dye was Intratherm Scarlet P355. Similar results were obtained.

EXAMPLE 33

A wool/polyester (50:50) fabric was prepared as described in Example 1.

Paper was printed with the following combinations of dyes, which are matched to give equivalent colours on the polyester and the wool.

(i) 1.6% Faran Brill. Yellow E-3GL (C.I. Disperse Yellow 54):

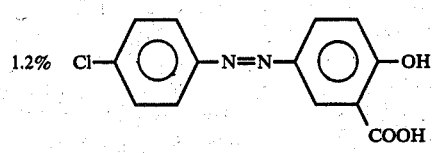

(ii) 1.0% Faran Scarlet D-2GFLK 0.6%:

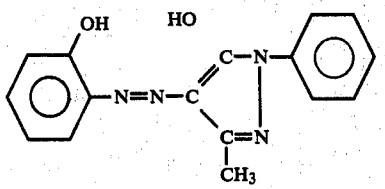

(iii) 0.8% Serisol Fast Crimson BD 0.45%:

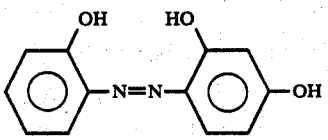

(iv) 0.8% Celliton Violet SF 7870 0.5%:

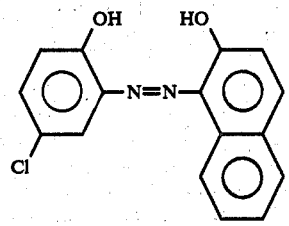

The pretreated wool/polyester was transfer printed with this paper and the print steamed, a solid 4-colour print of very good wash fastness was obtained. If the conventional disperse dyes were omitted from the mixture, a skittery print was obtained due to non-coloration of the polyester component.

EXAMPLE 34

Aliquat 336 was applied to wool serge fabric by exhaustion from long liquor at 30:1 liquor ratio by boiling for 30 minutes at pH 7. The fabric was then dried. Subsequent transfer printing of the fabric at 200° C. for 45 seconds with commercial transfer printing papers gave prints with a good colour yield.

EXAMPLE 35

Example 34 was repeated, using Sublinyl transfer papers. Both colour yield and sharpness of print were improved.

EXAMPLE 36

4% o.w.f. of an anionic/cationic surfactant (Allied Colloids RP 1401) applied to an all wool serge fabric by the pad-dry technique. The fabric was then printed with sublinyl transfer print papers at 200° C. for 45 seconds. Good prints were again obtained.

EXAMPLE 37

Example 36 was repeated using cetyl pyridinium chloride, and good prints were again obtained.

EXAMPLE 38

Examples 36 and 37 were repeated including 5% o.w.f. sulphamic acid in the pad liquor. Good prints were obtained with little or no yellowing of unprinted areas.

EXAMPLE 39

Examples 34 to 38 were repeated using 60/40 wool/polyester woven fabric. In all cases excellent prints were obtained.

EXAMPLE 40

Sodium lauryl sulphate was applied to a woven wool/polyester fabric and the latter dried. The fabric was then printed with Sublinyl papers, and excellent prints with little or no yellowing were obtained. EXAMPLE 41

Examples 34 to 40 were repeated on both all wool serge and wool/polyester, where the fabric was first treated for 30 minutes at a liquor ratio of 30:1 in a bath containing 5 gpl zinc formaldehyde sulphoxylate (Blankit D, BASF) and the appropriate auxiliaries. Where the surfactant was to be applied by a pad-dry procedure, the fabric was dried prior to padding. A significant improvement in yield was observed when the samples were transfer-printed as described above. The yield was improved still further when the reductive pretreatment time was extended to 1 hour.

EXAMPLE 42

Examples 34 to 41 were repeated and the transfer-printed samples steamed for 30 minutes at 102° C. Both yield and wet fastness properties were improved.

What is claimed is:

1. A method of coloring a textile material containing natural fiber with enhanced color yield consisting of the steps of:

applying to said material a solution consisting of at least one anionic or cationic surface active agent effective to enhance the color yield in subsequent coloring and a solvent for said surface active agent and drying said material to leave deposited thereon from 1 to 10% by weight, based on the weight of the textile, of said at least one surface active agent;

applying a sublimable dye to said textile material in the dry condition in the presence of said at least one surface active agent;

and subjecting said textile material bearing said dye and said at least one surface active agent to heat thereby fixing said dye on said textile material; wherein, said anionic or cationic surface active agent is an organic compound consisting of a polar group and a non-polar group, said non-polar group consisting of a straight chain, branched chain, ring chain or unsaturated alkyl group containing from one to twenty carbon atoms, and said polar group consisting of (1) an anionic group selected from the group consisting of carboxylate, sulfate, thiosulfate, sulfonate, sulfinate, sulfamate, phosphate, pyrophospate and phosphonite, or (2) a cationic group selected from the group consisting of protonated primary, secondary and tertiary amine groups and quaternary ammonium, pyridium, picolinium, imidazole, benzimidazole, tertiary oxonium, tertiary sulfonium and quaternary phosphonium groups.

2. The method of claim 1 wherein said anionic or cationic surface active agent is selected from the group consisting of sodium stearate, sodium di-isooctylsulphosuccinate, sodium dodecylbenzenesulphonate, sodium laurylsulphate, N-methyltaurine adduct of oleic acid chloride, alkylnaphthalene sulphonate, sulphonated alkylbenzimidazole, lauryl diethanolamide, cetyltrimethylammonium bromide, cetylbenzyldimethylammonium chloride, condensate of lauryl chloride with diethylethylene diamine and N-trioctyl-N-methyl ammonium chloride.

3. The method of claim 1 wherein from 2 to 5% by weight of said surface active agent by weight of said material is deposited on the material.

4. The method of claim 1 wherein said dye is printed on said material.

5. The method of claim 1 wherein said dye contains at least one reactive group selected from the class consisting of chelatable groups, fibre-reactive groups and cross-linkable groups.

6. The method of claim 1 wherein said dye is applied to said material by the steps of:

providing said dye printed on a transfer sheet;

applying said printed transfer sheet to said material;

and heating said sheet in contact with said material and thereby transferring said dye from said sheet to said material.

7. A method of coloring a textile material containing natural fiber with enhanced color yield consisting of the steps of:

applying to said material a solution consisting of at least one compound selected from the class consisting of: dye diffusion promoters, chelating metal compounds, organic carboxylic acids, cross-linking agents, catalysts, textile finishing agents and solvents, at least one anionic or cationic surface active agent effective to enhance the color yield in subsequent coloring and a solvent for said surface active agent and drying said material to leave deposited thereon from 1 to 10% by weight, based on the weight of the textile, of said at least one surface active agent;

applying a sublimable dye to said textile material in the dry condition in the presence of said at least one surface active agent;

and subjecting said textile material bearing said dye and said at least one surface active agent to heat thereby fixing said dye on said textile material; wherein, said anionic or cationic surface active agent is an organic compound consisting of a polar group and a non-polar group, said non-polar group consisting of a straight chain, branched chain, ring chain or unsaturated alkyl group containing from one to twenty carbon atoms, and said polar group consisting of (1) an anionic group selected from the group consisting of carboxylate, sulfate, thiosulfate, sulfonate, sulfinate, sulfamate, phosphate, pyrophosphate and phosphonite, or (2) a cationic group selected from the group consisting of protonated primary, secondary and tertiary amine groups and quaternary ammonium, pyridium, picolinium, imidazole, benzimidazole, tertiary oxonium, tertiary sulfonium and quaternary phosphonium groups.

8. In the method of printing textile or like material containing natural fibers consisting of the steps of:

printing a sublimable dye on a transfer sheet;

applying said sheet in contact with said material and thereby transferring said dye from said sheet to said material, the improvement consisting of:

pretreating said material by depositing therein from 1 to 10% by weight, based on the weight of the textile, of at least one anionic or cationic surface active agent effective to enhance the color yield in such printing; wherein, said anionic or cationic surface active agent is an organic compound consisting of a polar group and a non-polar group consisting of a straight chain, branched chain, ring chain or unsaturated alkyl group containing from one to twenty carbon atoms, said polar group consisting of (1) an anionic group selected from the group consisting of carboxylate, sulfate, thiosulfate, sulfonate, sulfinate, sulfamate, phosphate, pyrophosphate and phosphonite, or (2) a cationic group selected from the group consisting of protonated primary, secondary and tertiary amine groups and quaternary ammonium, pyridium, picolinium, imidazole, benzimidazole, tertiary oxonium, tertiary solfonium and quaternary phosphonium groups.

* * * * *